US009347324B2

(12) United States Patent
Lee

(10) Patent No.: US 9,347,324 B2
(45) Date of Patent: May 24, 2016

(54) TURBINE AIRFOIL VANE WITH AN IMPINGEMENT INSERT HAVING A PLURALITY OF IMPINGEMENT NOZZLES

(71) Applicant: Ching-Pang Lee, Cincinnati, OH (US)

(72) Inventor: Ching-Pang Lee, Cincinnati, OH (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 194 days.

(21) Appl. No.: 14/133,773

(22) Filed: Dec. 19, 2013

(65) Prior Publication Data

US 2014/0105726 A1 Apr. 17, 2014

Related U.S. Application Data

(63) Continuation-in-part of application No. 12/885,740, filed on Sep. 20, 2010, now abandoned.

(51) Int. Cl.
*F01D 5/18* (2006.01)
*F01D 9/04* (2006.01)

(52) U.S. Cl.
CPC ..... *F01D 5/188* (2013.01); *F01D 9/04* (2013.01); *F05D 2210/33* (2013.01); *F05D 2240/12* (2013.01); *F05D 2240/127* (2013.01); *F05D 2260/2212* (2013.01)

(58) Field of Classification Search
CPC ..... F01D 5/188; F01D 9/04; F05D 2240/12; F05D 2210/33; F05D 2240/127; F05D 2260/2212
USPC ..... 415/115; 416/97 R
See application file for complete search history.

(56) References Cited

U.S. PATENT DOCUMENTS

| | | | | |
|---|---|---|---|---|
| 5,259,730 | A | 11/1993 | Damlis et al. | |
| 5,328,331 | A | 7/1994 | Bunker et al. | |
| 5,352,091 | A | 10/1994 | Sylvestro | |
| 5,363,654 | A * | 11/1994 | Lee | F23R 3/002 165/908 |
| 5,467,815 | A * | 11/1995 | Haumann | F01P 1/02 165/109.1 |
| 5,586,866 | A | 12/1996 | Wettstein | |
| 6,382,906 | B1 * | 5/2002 | Brassfield | F01D 5/18 415/115 |
| 6,439,846 | B1 | 8/2002 | Anderson et al. | |
| 6,607,355 | B2 * | 8/2003 | Cunha | F01D 5/18 416/97 R |
| 6,659,714 | B1 * | 12/2003 | Tiemann | F01D 5/188 415/115 |
| 6,769,875 | B2 | 8/2004 | Tiemann | |

(Continued)

OTHER PUBLICATIONS

Eastman, Aaron; Non-final Office Action in U.S. Appl. No. 12/885,740 dated Oct. 2, 2013; United States Patent and Trademark Office; Alexandria, VA.

*Primary Examiner* — Igor Kershteyn
*Assistant Examiner* — Aaron R Eastman

(57) ABSTRACT

A turbine vane includes a generally elongated hollow airfoil and a cooling system. The cooling system is positioned within the airfoil and includes a cooling chamber and an impingement insert positioned in the cooling chamber. The impingement insert and an inner surface of an outer wall of the airfoil define a cooling channel therebetween. The impingement insert includes a plurality of impingement nozzles extending toward the inner surface of the outer wall and a plurality of impingement orifices. At least one of the impingement orifices is arranged in a non-aligned pattern with respect to at least one adjacent impingement orifice such that cooling fluid passing out of the at least one impingement orifice does not directly flow into a centerline of a cooling fluid flowpath of cooling fluid passing out of the at least one adjacent impingement orifice.

19 Claims, 4 Drawing Sheets

(56) References Cited

U.S. PATENT DOCUMENTS

| | | | | |
|---|---|---|---|---|
| 6,913,440 | B2 * | 7/2005 | Ciacci | F01D 5/186 415/115 |
| 6,929,446 | B2 * | 8/2005 | Lu | F01D 5/186 415/115 |
| 7,008,178 | B2 * | 3/2006 | Busch | F01D 5/189 415/115 |
| 7,008,185 | B2 * | 3/2006 | Peterman | F01D 5/189 415/115 |
| 7,063,506 | B2 | 6/2006 | Davison et al. | |
| RE39,479 | E * | 1/2007 | Tressler | F01D 5/189 415/115 |
| 7,412,320 | B2 * | 8/2008 | Brummel | F01D 5/189 415/115 |
| 7,497,655 | B1 | 3/2009 | Liang | |
| 8,152,468 | B2 | 4/2012 | Propheter-Hinckley et al. | |
| 2004/0099005 | A1 * | 5/2004 | Newman | F25D 3/11 62/374 |
| 2010/0247327 | A1 * | 9/2010 | Malecki | F01D 5/189 416/96 A |
| 2011/0027102 | A1 * | 2/2011 | Nakamata | F01D 5/186 416/97 R |
| 2012/0006028 | A1 * | 1/2012 | Lee | F01D 9/023 60/725 |
| 2012/0070302 | A1 | 3/2012 | Lee | |
| 2013/0031914 | A1 * | 2/2013 | Lee | F01D 5/186 60/806 |

* cited by examiner

TURBINE AIRFOIL VANE WITH AN IMPINGEMENT INSERT HAVING A PLURALITY OF IMPINGEMENT NOZZLES

CROSS REFERENCE TO RELATED APPLICATIONS

This application is a Continuation-In-Part of U.S. patent application Ser. No. 12/885,740, filed Sep. 20, 2012, entitled "TURBINE AIRFOIL VANE WITH AN IMPINGEMENT INSERT HAVING A PLURALITY OF IMPINGEMENT NOZZLES" by Ching-Pang Lee, the entire disclosure of which is incorporated by reference herein.

FIELD OF THE INVENTION

This invention is directed generally to turbine airfoil vanes, and more particularly to hollow turbine airfoil vanes having an impingement insert for passing fluids, such as air, to cool the airfoils.

BACKGROUND OF THE INVENTION

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to these high temperatures. As a result, turbine vanes and blades must be made of materials capable of withstanding such high temperatures. In addition, turbine vanes and blades often contain cooling systems for prolonging the life of the vanes and blades and reducing the likelihood of failure as a result of excessive temperatures.

Typically, turbine vanes are formed from an elongated portion forming a vane having one end configured to be coupled to a vane carrier and an opposite end configured to be movably coupled to an inner endwall. The vane is ordinarily composed of a leading edge, a trailing edge, a suction side, and a pressure side. The inner aspects of most turbine vanes typically contain an intricate maze of cooling circuits forming a cooling system. The cooling circuits in the vanes receive cooling fluid, e.g., air from the compressor of the turbine engine, and pass the fluid through the ends of the vane adapted to be coupled to the vane carrier. The cooling circuits often include multiple flow paths that are designed to maintain all aspects of the turbine vane at a relatively uniform temperature. At least some of the fluid passing through these cooling circuits is exhausted through orifices in the leading edge, trailing edge, suction side, and pressure side of the vane.

The cooling system, as shown in FIG. 3, may include an impingement plate 3 with a plurality of impingement holes 4 for directing cooling fluids to impinge on the outer wall 6 forming a turbine airfoil. The impingement plate 3 may be offset from the outer wall 6 a conventional distance. The impingement plate 3 may be generally flat and reside in a single plane. In this configuration, the cross flow of cooling fluids often disrupts the impingement jets directed towards the outer wall, thereby negatively impacting the cooling function of the impingement jets. While advances have been made in the cooling systems in turbine vanes, a need still exists for a turbine vane having increased cooling efficiency for dissipating heat and passing a sufficient amount of cooling fluid through the vane.

SUMMARY OF THE INVENTION

In accordance with a first aspect of the invention, a turbine vane is provided comprising a generally elongated hollow airfoil and a cooling system. The airfoil comprises an outer wall including a leading edge, a trailing edge, a pressure side, a suction side, an outer endwall at a first end, and an inner endwall at a second end opposite the first end. The cooling system is positioned within the airfoil and comprises a cooling chamber and an impingement insert positioned in the cooling chamber. The impingement insert and an inner surface of the airfoil outer wall define a cooling channel therebetween. The impingement insert includes a plurality of impingement nozzles extending toward the inner surface of the outer wall and a plurality of impingement orifices. At least one of the impingement orifices is arranged in a non-aligned pattern with respect to at least one adjacent impingement orifice such that cooling fluid passing out of the at least one impingement orifice does not directly flow into a centerline of a cooling fluid flowpath of cooling fluid passing out of the at least one adjacent impingement orifice.

Each impingement orifice may be arranged in a non-aligned pattern with respect to at least one adjacent impingement orifice such that cooling fluid passing out of each impingement orifice does not directly flow into a centerline of a cooling fluid flowpath of cooling fluid passing out of the at least one adjacent impingement orifice.

The orifices may be arranged in a staggered pattern comprising alternating first and second rows that are offset from one another in a flow direction of cooling fluid through the cooling channel.

Each of the impingement orifices may be formed in an outermost aspect of a corresponding impingement nozzle, and the impingement nozzles may have a generally cylindrical cross sectional area. Each impingement nozzle may include at least one impingement orifice for directing cooling fluids orthogonally away from the impingement insert. A distance between the outermost aspect of the impingement nozzle and the inner surface of the outer wall may be less than half of a distance between an innermost aspect of the impingement insert and the inner surface of the outer wall.

Only select ones of the impingement nozzles may include a corresponding impingement orifice formed therein.

In accordance with a second aspect of the invention, a turbine vane is provided comprising a generally elongated hollow airfoil and a cooling system. The airfoil comprises an outer wall including a leading edge, a trailing edge, a pressure side, a suction side, an outer endwall at a first end, and an inner endwall at a second end opposite the first end. The cooling system is positioned within the airfoil and comprises a cooling chamber and an impingement insert positioned in the cooling chamber. The impingement insert and an inner surface of the airfoil outer wall define a cooling channel therebetween. The impingement insert includes a plurality of impingement nozzles extending toward the inner surface of the outer wall and a plurality of impingement orifices. The impingement orifices are arranged in a staggered pattern comprising alternating first and second rows that are offset from one another in a flow direction of cooling fluid through the cooling channel such that cooling fluid passing out of each respective impingement orifice does not directly flow into a centerline of a cooling fluid flowpath of cooling fluid passing out of the adjacent upstream impingement orifice.

In accordance with a third aspect of the invention a turbine vane is provided comprising a generally elongated hollow airfoil and a cooling system. The airfoil comprises an outer wall including a leading edge, a trailing edge, a pressure side, a suction side, an outer endwall at a first end, and an inner endwall at a second end opposite the first end. The cooling system is positioned within the airfoil and comprises a cooling chamber and an impingement insert positioned in the cooling chamber. The impingement insert and an inner surface of the airfoil outer wall define a cooling channel therebetween. The impingement insert includes a plurality of impingement nozzles extending toward the inner surface of the outer wall and a plurality of impingement orifices. The impingement orifices are formed in corresponding impingement nozzles and are arranged in a non-aligned pattern with respect to at least one adjacent impingement orifice such that cooling fluid passing out of the impingement orifices does not directly flow into a centerline of a cooling fluid flowpath of cooling fluid passing out of the at least one adjacent impingement orifice. A distance between an outermost aspect of at least one impingement nozzle including an impingement orifice and the inner surface of the outer wall is less than half of a distance between an innermost aspect of the impingement insert and the inner surface of the outer wall.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

Figure 1:
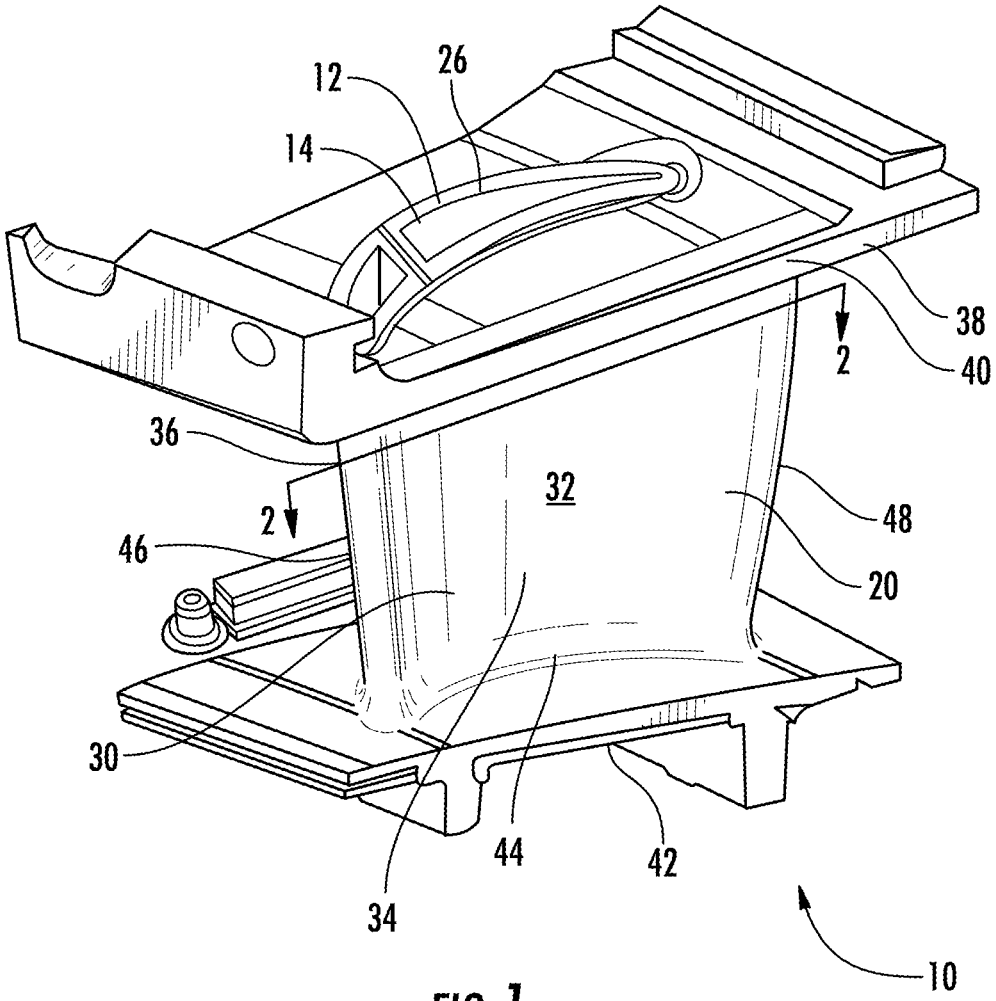
FIG. 1 is a perspective view of a turbine vane having features according to the instant invention.

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

As shown in FIGS. 1-5, this invention is directed to a turbine airfoil vane 10 usable in a turbine engine. The turbine vane 10 may include one or more cooling systems 12 with an impingement plate 14, also referred to herein as an impingement insert 14, having one or more impingement nozzles 16. The turbine vane impingement nozzles 16 may extend towards an outer wall 20 forming the turbine vane 10 and may reduce the mixing of cooling fluids with impingement jets 22. Instead, the nozzles 16 may terminate within close proximity of the outer wall 20, thereby reducing the effect of cooling fluid cross flow 62.

The cooling system 12 may be configured to cool internal and external aspects of the turbine vane 10 usable in a turbine engine. In at least one embodiment, the turbine airfoil cooling system 12 may be configured to be included within a stationary turbine vane 10, as shown in FIGS. 1-4. The cooling system 12 may include one or more cooling chambers 26. For instance, the cooling chambers 26 may include one or more midcord cooling chambers 28 positioned in the outer wall 20.

Figure 2:
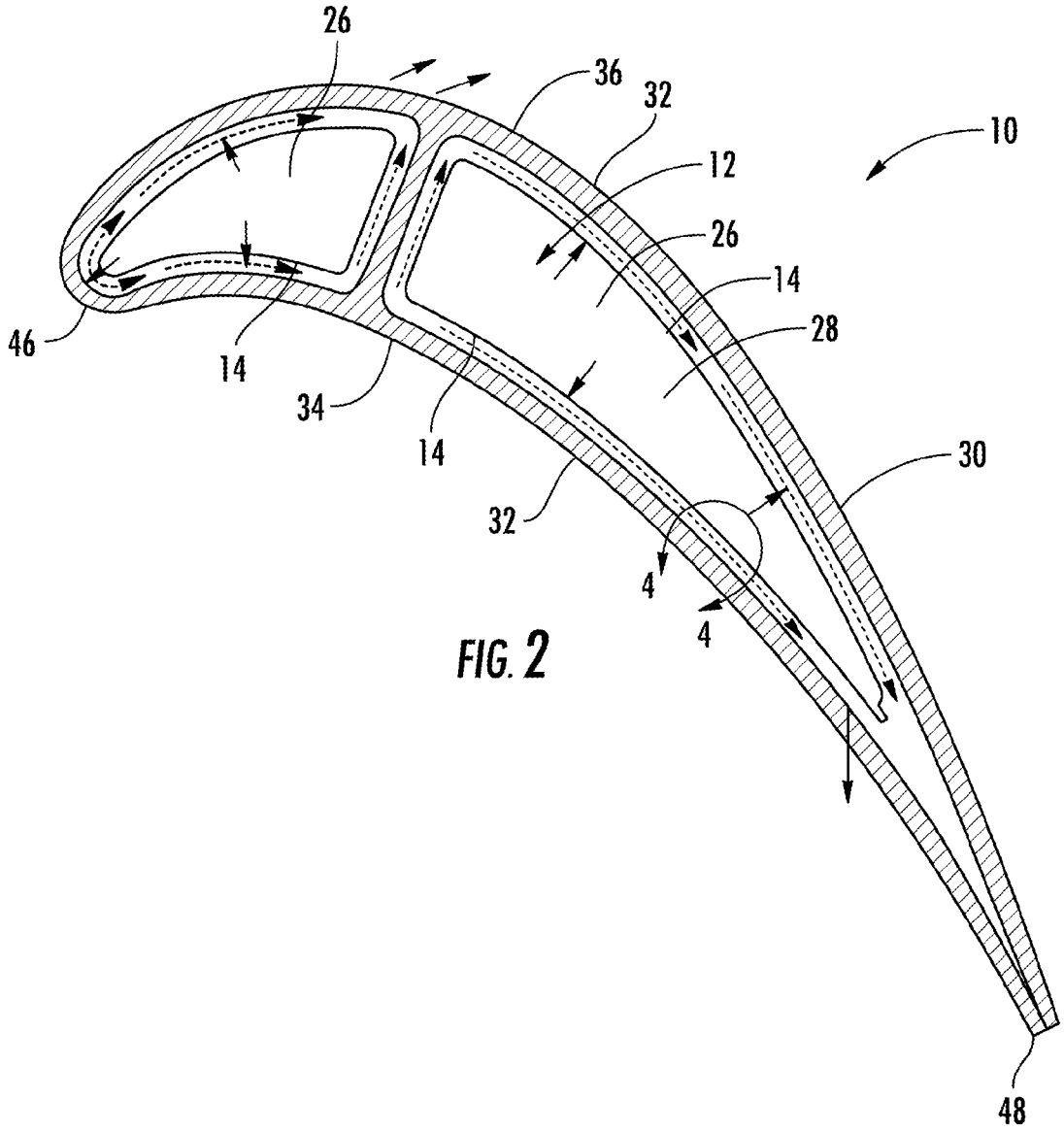
FIG. 2 is a cross-sectional view of the turbine vane shown in FIG. 1 taken along line 2-2.

As shown in FIGS. 1-2, the turbine vane 10 may be formed from a generally elongated hollow airfoil 30 having an outer surface 32 adapted for use, for example, in an axial flow turbine engine. Outer surface 32 may have a generally concave shaped portion forming the pressure side 34 and a generally convex shaped portion forming the suction side 36. The turbine vane 10 may also include an outer endwall 38 at a first end 40 adapted to be coupled to a hook attachment and may include an inner endwall 42 at a second end 44. The airfoil 30 may also include a leading edge 46 and a trailing edge 48 opposite the leading edge 46.

Figure 4:
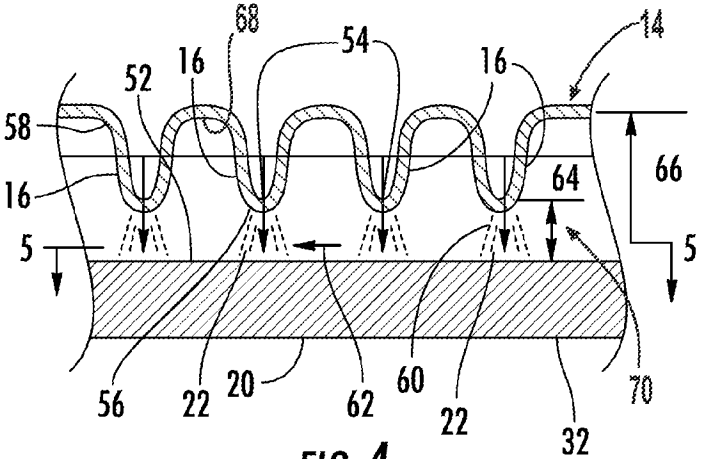
FIG. 4 is a cross-sectional, detailed view taken at detail line 4-4 in FIG. 2 displaying an impingement insert with a plurality of impingement nozzles.

As shown in FIG. 2, the turbine vane 10 may include an impingement insert 14 positioned in internal aspects of a central cooling chamber 26 of the cooling system 12. The impingement insert 14 may include a plurality of impingement nozzles 16, as shown in FIG. 4, extending from the impingement insert 14. In at least one embodiment, the nozzles 16 may extend toward an inner surface 52 of the outer wall 20 from the impingement insert 14. One or more of the nozzles 16 may include one or more impingement orifices 54. Each nozzle 16 may include at least one impingement orifice 54 positioned at an outermost aspect 56 of the nozzle 16 for directing cooling fluids orthogonally away from the impingement insert 14.

In at least one embodiment, one or more impingement nozzles 16 may be generally cylindrical. As such, a plurality of impingement nozzles 16 may be generally cylindrical. In other embodiments, one or more impingement nozzles 16 may have a cross-sectional area formed as a cylinder, a rectangle, a triangle, a semicircle, and other appropriate shapes. The impingement nozzles 16 may also be configured with a conical shape such that a cross-sectional area at a base 58 is greater than a cross-sectional area at the outermost aspect 56. One or a plurality of impingement nozzles 16 may be configured have a generally conical shape and may include one or more impingement orifices 54.

Figure 5:
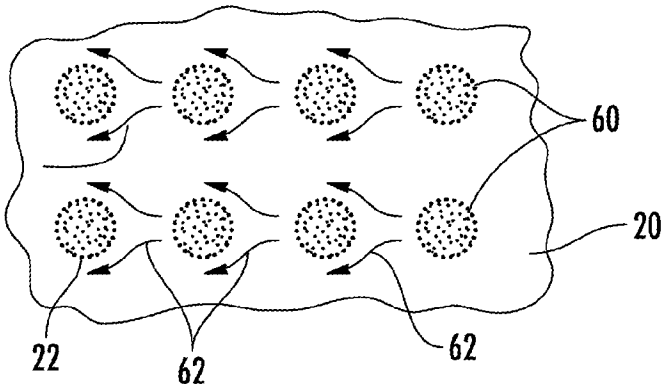
FIG. 5 is a partial view of the inner surface of the outer wall taken along line 5-5 in FIG. 4 showing the impingement jets striking the outer wall and cross flow flowing therebetween.

The impingement nozzles 16 may be aligned into rows, as shown in FIG. 5 through depiction of the impingement jets 60. The rows may extend in a generally spanwise direction, in a generally chordwise direction or other appropriate direction. Adjacent rows may be offset from each other as will be discussed in greater detail below.

Figure 3:
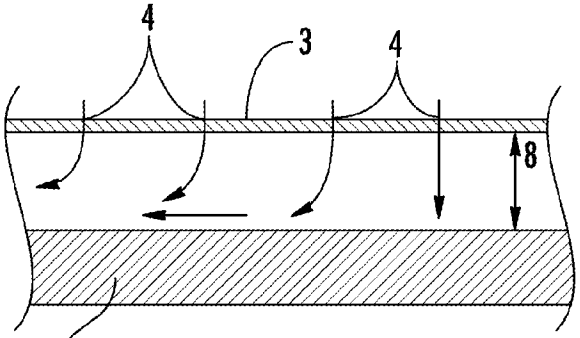
FIG. 3 (PRIOR ART)
FIG. 3 is a cross-sectional, detailed view taken of an outer wall of a conventional turbine airfoil with an impingement insert.

The outermost aspect 56 of the impingement nozzle 16 and the impingement orifices 54 may be located a distance 64 that is less than a conventional distance 8 between a conventional impingement plate 3 with holes 4 and an outer wall 6 of a conventional vane, see FIGS. 3 and 4. In addition, a distance between an innermost aspect 68 of the impingement insert 14 and the inner surface 52 of the outer wall 20 is greater than a conventional distance 8 between the conventional impingement plate 3 with holes 4 and the outer wall 6 of the conventional vane, and is greater than twice the distance 64 between the outermost aspect 56 of the impingement nozzle 16 and the inner surface 52 of the outer wall 20, i.e., the distance 64 between the outermost aspect 56 of the impingement nozzle 16 and the inner surface 52 of the outer wall 20 is less than half of the distance between the innermost aspect 68 of the impingement insert 14 and the inner surface 52 of the outer wall 20. In such a configuration, the cross-sectional areas between the impingement nozzles 16 and the outer wall 20 is less than the distance 64 between the impingement insert 14 and the outer wall 20. Thus, the impingement nozzles 16 may be placed in closer position relative to outer wall 20 without changing overall volume of cooling fluid flow through a cooling channel 70 formed between the outer wall 20 and the impingement insert 14.

As shown in FIGS. 4 and 5, during use, cooling fluids may flow from a cooling fluid supply source (not shown) into the cooling system 12. The cooling fluids may be passed into the cooling channel 70 formed between the impingement insert 14 and the outer wall 20 through the impingement nozzles 16 and the impingement orifices 54 positioned at the outermost aspect 56 of the nozzles 16. The size and configuration of the jet 60 of cooling fluids flowing from the nozzle 16 is controlled by the shape and size of the nozzle 16. In at least one embodiment in which the nozzles 16 are generally circular, the impingement jets 60 may be generally circular when the cooling fluids strike the inner surface 52 of the outer wall 20, as shown in FIG. 5. After the cooling fluids impinge upon the inner surface 52 of the outer wall 20, the cooling fluids form a cross flow 62 flowing generally along the outer wall 20. Because the nozzles 16 extend to within close proximity of the outer wall 20, the impingement jets 60 have sufficient velocity such that the cross flow 62 does not disrupt the impingement jets 60. The cooling fluids flowing from the impingement nozzles 16 reduce the temperature of the outer wall 20.

Figure 6:
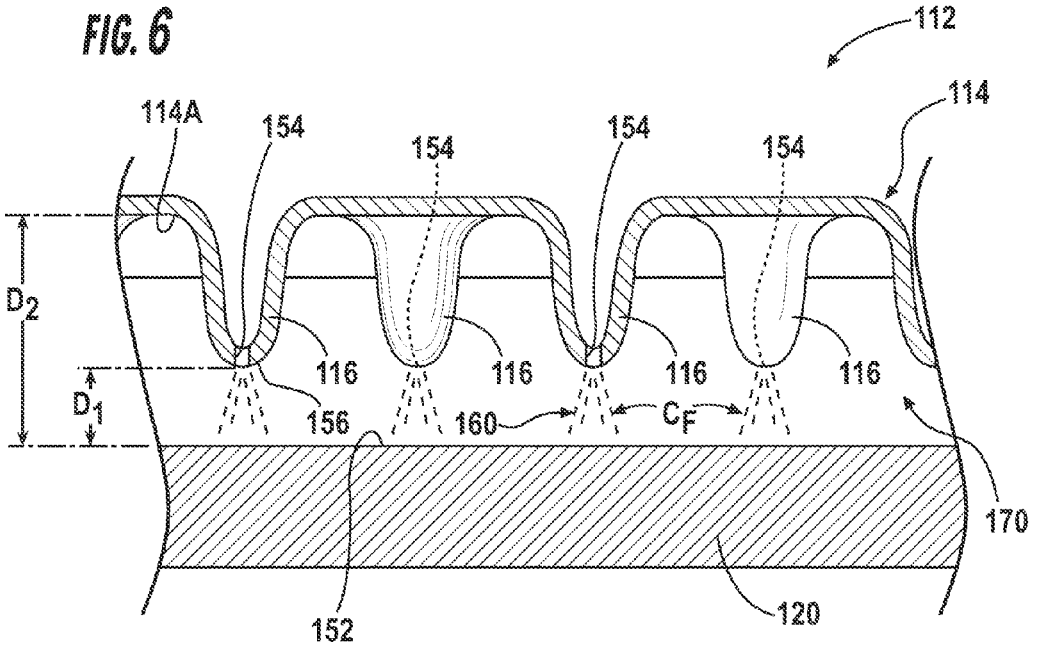
FIGS. 6 and 7 are views similar to those of FIGS. 4 and 5 illustrating an impingement insert in accordance with another embodiment of the instant invention.
Figure 7:
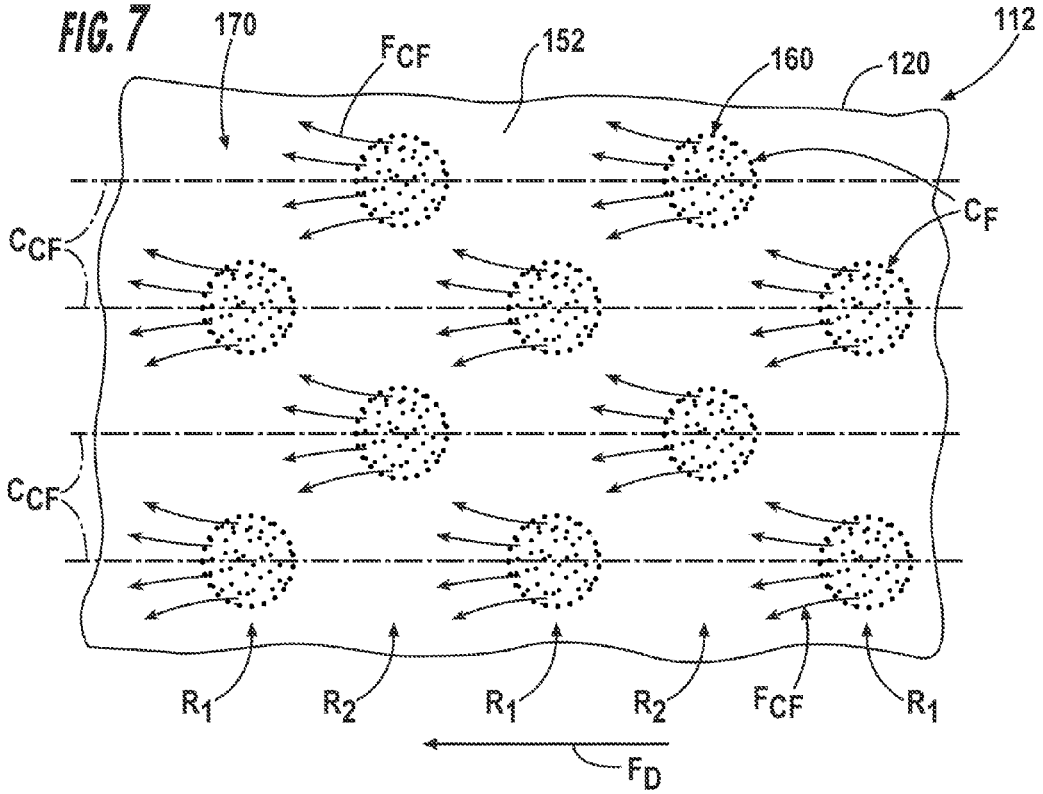

Referring now to FIGS. 6 and 7, in accordance with another aspect of the present invention, where like structure to that of FIGS. 1-5 includes the same reference number increased by 100, an impingement insert 114 and an inner surface 152 of an airfoil outer wall 120 define a cooling channel 170 therebetween. The general structure of the airfoil outer wall 120 according to this aspect of the invention may be similar to that of the airfoil outer wall 20 as described above with reference to FIGS. 1-5.

The impingement insert 114 according to this aspect of the invention is part of a cooling system 112 and includes a plurality of impingement nozzles 116 extending toward the inner surface 152 of the airfoil outer wall 120. Similar to the impingement nozzles 16 discussed above, the impingement nozzles 116 may have a generally cylindrical cross sectional area, as shown in FIG. 6.

Select ones or all of the impingement nozzles 116 according to this aspect of the invention include at least one impingement orifice 154 located at an outermost aspect 156 of the impingement nozzle 116 for directing cooling fluid $C_F$ orthogonally away from the impingement insert 114, see FIG. 6. As shown in FIG. 6, a distance $D_1$ between the outermost aspect 156 of the impingement nozzles 116 and the inner surface 152 of the airfoil outer wall 120 may be less than half of a distance $D_2$ between an innermost aspect 114A of the impingement insert 114 and the inner surface 152 of the outer wall 120. Hence, cooling fluid $C_F$ is discharged from the impingement nozzles 116 generally close to the inner surface 152 of the outer wall 120 to maximize impingement cooling of the outer wall 120 provided by the cooling fluid $C_F$ and to reduce disruption of the post impingement cooling fluid $C_F$ flowing normal to the impinging jets 160 within the cooling channel 170, as will be discussed further below.

Referring now to FIG. 7, at least one of the impingement orifices 154 (and all of the impingement orifices 154 shown in FIG. 7) is arranged in a non-aligned pattern with respect to at least one adjacent impingement orifice 154. For example, in the exemplary configuration shown in FIG. 7, the impingement orifices 154 are arranged in a staggered pattern comprising alternating first and second rows $R_1$, $R_2$ that are offset from one another in a flow direction $F_D$ of the post impingement cooling fluid $C_F$ flowing in parallel to the outer wall 120 through the cooling channel 170. Hence, cooling fluid $C_F$ passing out of the at least one impingement orifice 154 does not directly flow into a centerline $C_{CF}$ of a cooling fluid flowpath $F_{CF}$ of cooling fluid $C_F$ passing out of the at least one adjacent impingement orifice 154.

As noted above, only select ones of the impingement nozzles 116 according to this aspect of the invention may include a corresponding impingement orifice 154 formed therein. Ones of the impingement nozzles 116 that do not include an impingement orifice could be provided to effect a more turbulent flow of cooling fluid $C_F$ through the cooling channel 170 to increase cooling provided to the outer wall 120 by the cooling fluid $C_F$.

As shown in FIGS. 6 and 7, during use, cooling fluid $C_F$ may flow from a cooling fluid supply source (not shown) into the cooling system 112. The cooling fluid $C_F$ may be passed into the cooling channel 170 of the cooling system 112 between the impingement insert 114 and the outer wall 120 through the impingement nozzles 116 and the impingement orifices 154 positioned at the outermost aspect 156 of the nozzles 116. The size and configuration of the jets 160 of the cooling fluid $C_F$ discharged from the nozzles 116 is controlled by the shape and size of the nozzles 116. In at least one embodiment in which the nozzles 116 are generally circular, the impingement jets 160 may be generally circular when the cooling fluid $C_F$ strikes the inner surface 152 of the outer wall 120, as shown in FIG. 7. After the cooling fluid $C_F$ impinges upon the inner surface 152 of the outer wall 120, the cooling fluid $C_F$ flows through the cooling channel 170 along the cooling fluid flowpath $F_{CF}$ generally along the outer wall 120. Because the nozzles 116 extend to within close proximity of the outer wall 120, the impingement jets 160 have sufficient velocity such that the cooling fluid $C_F$ flowing along their respective cooling fluid flowpaths $F_{CF}$ does not disrupt the impingement jets 160. Additionally, less disruption of the jets 160 and of the cooling fluid flowpaths $F_{CF}$ is effected by the nozzles 116 of the present aspect of the invention, since the cooling fluid $C_F$ passing out of the impingement orifices 154 does not directly flow into the centerlines $C_{CF}$ of the cooling fluid flowpaths $F_{CF}$ of the cooling fluid $C_F$ passing out of the adjacent impingement orifices 154. The cooling fluid $C_F$ flowing from the impingement nozzles 116 reduces the temperature of the outer wall 120.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A turbine vane, comprising:

a generally elongated hollow airfoil comprising an outer wall, the outer wall including a leading edge, a trailing edge, a pressure side, a suction side, an outer endwall at a first end, and an inner endwall at a second end opposite the first end; and a cooling system positioned within the airfoil, the cooling system comprising a cooling chamber and an impingement insert positioned in the cooling chamber, the impingement insert and an inner surface of the airfoil outer wall defining a cooling channel therebetween, the impingement insert including:

a plurality of impingement nozzles extending toward the inner surface of the outer wall; and a plurality of impingement orifices, at least one of the impingement orifices being arranged in a non-aligned pattern with respect to at least one adjacent impingement orifice such that cooling fluid passing out of the at least one impingement orifice does not directly flow into a centerline of a cooling fluid flowpath of cooling fluid passing out of the at least one adjacent impingement orifice, to reduce disruption of a post impingement cooling fluid flowing normal to impinging jets flowing out of the impingement orifices within the cooling channel.

2. The turbine vane of claim 1, wherein each impingement orifice is arranged in a non-aligned pattern with respect to at least one adjacent impingement orifice such that cooling fluid passing out of each impingement orifice does not directly flow into a centerline of a cooling fluid flowpath of cooling fluid passing out of the at least one adjacent impingement orifice.

3. The turbine vane of claim 2, wherein the orifices are arranged in a staggered pattern comprising alternating first and second rows that are offset from one another in a flow direction of cooling fluid through the cooling channel.

4. The turbine vane of claim 1, wherein each of the impingement orifices is formed in an outermost aspect of a corresponding impingement nozzle.

5. The turbine vane of claim 4, wherein the impingement nozzles have a generally cylindrical cross sectional area.

6. The turbine vane of claim 4, wherein each impingement nozzle includes at least one impingement orifice for directing cooling fluids orthogonally away from the impingement insert.

7. The turbine vane of claim 4, wherein a distance between the outermost aspect of the impingement nozzle and the inner surface of the outer wall is less than half of a distance between an innermost aspect of the impingement insert and the inner surface of the outer wall.

8. The turbine vane of claim 1, wherein only select ones of the impingement nozzles include a corresponding impingement orifice formed therein.

9. A turbine vane, comprising:

a generally elongated hollow airfoil comprising an outer wall, the outer wall including a leading edge, a trailing edge, a pressure side, a suction side, an outer endwall at a first end, and an inner endwall at a second end opposite the first end; and a cooling system positioned within the airfoil, the cooling system comprising a cooling chamber and an impingement insert positioned in the cooling chamber, the impingement insert and an inner surface of the airfoil outer wall defining a cooling channel therebetween, the impingement insert including:

a plurality of impingement nozzles extending toward the inner surface of the outer wall; and a plurality of impingement orifices arranged in a staggered pattern comprising alternating first and second rows that are offset from one another in a flow direction of cooling fluid through the cooling channel such that cooling fluid passing out of each respective impingement orifice does not directly flow into a centerline of a cooling fluid flowpath of cooling fluid passing out of the adjacent upstream impingement orifice, to reduce disruption of a post impingement cooling fluid flowing normal to impinging jets flowing out of the impingement orifices within the cooling channel.

10. The turbine vane of claim 9, wherein each of the impingement orifices is formed in an outermost aspect of a corresponding impingement nozzle.

11. The turbine vane of claim 10, wherein only select ones of the impingement nozzles include a corresponding impingement orifice formed therein.

12. The turbine vane of claim 10, wherein the impingement nozzles have a generally cylindrical cross sectional area.

13. The turbine vane of claim 10, wherein each impingement nozzle includes at least one impingement orifice for directing cooling fluids orthogonally away from the impingement insert.

14. The turbine vane of claim 10, wherein a distance between the outermost aspect of the impingement nozzle and the inner surface of the outer wall is less than half of a distance between an innermost aspect of the impingement insert and the inner surface of the outer wall.

15. A turbine vane, comprising:

a generally elongated hollow airfoil comprising an outer wall, the outer wall including a leading edge, a trailing edge, a pressure side, a suction side, an outer endwall at a first end, and an inner endwall at a second end opposite the first end; and a cooling system positioned within the airfoil, the cooling system comprising a cooling chamber and an impingement insert positioned in the cooling chamber, the impingement insert and an inner surface of the airfoil outer wall defining a cooling channel therebetween, the impingement insert including:

a plurality of impingement nozzles extending toward the inner surface of the outer wall; and a plurality of impingement orifices formed in corresponding impingement nozzles and being arranged in a non-aligned pattern with respect to at least one adjacent impingement orifice such that cooling fluid passing out of the impingement orifices does not directly flow into a centerline of a cooling fluid flowpath of cooling fluid passing out of the at least one adjacent impingement orifice, wherein a distance between an outermost aspect of at least one impingement nozzle including an impingement orifice and the inner surface of the outer wall is less than half of a distance between an innermost aspect of the impingement insert and the inner surface of the outer wall, to reduce disruption of a post impingement cooling fluid flowing normal to impinging jets flowing out of the impingement orifices within the cooling channel.

16. The turbine vane of claim 15, wherein the orifices are arranged in a staggered pattern comprising alternating first and second rows that are offset from one another in a flow direction of cooling fluid through the cooling channel.

17. The turbine vane of claim 15, wherein each impingement nozzle includes at least one impingement orifice for directing cooling fluids orthogonally away from the impingement insert.

18. The turbine vane of claim 17, wherein the impingement nozzles have a generally cylindrical cross sectional area.

19. The turbine vane of claim 17, wherein each of the impingement orifices is formed in an outermost aspect of a corresponding impingement nozzle.

* * * * *